US011527375B2

(12) United States Patent
Belisle et al.

(10) Patent No.: US 11,527,375 B2
(45) Date of Patent: Dec. 13, 2022

(54) RELAY CONTACTOR WITH COMBINED LINEAR AND ROTATION MOTION

(71) Applicant: Hamilton Sundstrand Corporation, Charlotte, NC (US)

(72) Inventors: Francis C. Belisle, Roscoe, IL (US); John A. Dickey, Caledonia, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 149 days.

(21) Appl. No.: 16/735,293

(22) Filed: Jan. 6, 2020

(65) Prior Publication Data

US 2021/0210298 A1 Jul. 8, 2021

(51) Int. Cl.

| | |
|---|---|
| ***H01H 50/64*** | (2006.01) |
| ***H01H 50/36*** | (2006.01) |
| ***H01H 50/20*** | (2006.01) |
| ***H01H 50/24*** | (2006.01) |

(52) U.S. Cl.

CPC ..... *H01H 50/643* (2013.01); *H01H 50/20* (2013.01); *H01H 50/24* (2013.01); *H01H 50/36* (2013.01); *H01H 50/641* (2013.01)

(58) Field of Classification Search

CPC ..... H01H 50/20; H01H 50/24; H01H 50/36; H01H 50/641; H01H 50/643; H01H 1/021; H01H 1/2041; H01H 1/365; H01H 3/42; H01H 50/546; H01H 50/60; H01H 9/32

See application file for complete search history.

(56) References Cited

U.S. PATENT DOCUMENTS

| | | | | |
|---|---|---|---|---|
| 4,628,396 | A | 12/1986 | Flemming | |
| 4,659,885 | A * | 4/1987 | Kashiwagi | H01H 33/6643 218/130 |
| 6,384,702 | B1 * | 5/2002 | Smith | H01H 9/46 200/275 |
| 6,476,697 | B2 | 11/2002 | Swartzentruber et al. | |
| 7,538,990 | B2 | 5/2009 | Belisle et al. | |
| 7,754,992 | B2 | 7/2010 | Stepniak et al. | |
| 8,031,486 | B2 | 10/2011 | Wavering et al. | |

(Continued)

FOREIGN PATENT DOCUMENTS

| | | |
|---|---|---|
| EP | 2996136 A1 | 3/2016 |
| EP | 3477677 A1 | 5/2019 |

(Continued)

OTHER PUBLICATIONS

Partial European Search Report Application No. EP21150287; dated Jun. 24, 2021; pp. 12.

(Continued)

*Primary Examiner* — Bernard Rojas

(74) *Attorney, Agent, or Firm* — Cantor Colburn LLP

(57) ABSTRACT

A relay contactor is provided and includes a shaft assembly comprising a plate, which is movable between an open position at which the plate is displaced from leads and a closed position at which the plate contacts the leads and an actuation system configured to selectively move the plate into the closed position. At least one of the shaft assembly and the actuation system is configured such that, as the plate moves into and away from the closed position, a movement of the plate relative to the leads comprises at least a non-linear, rotational or an abnormally linear component.

16 Claims, 7 Drawing Sheets

(56) References Cited

U.S. PATENT DOCUMENTS

| | | | | |
|---|---|---|---|---|
| 8,559,149 | B2 | 10/2013 | Wavering et al. | |
| 9,882,357 | B2 | 1/2018 | Pal | |
| 10,150,433 | B2 | 12/2018 | Pal | |
| 10,305,261 | B2 | 5/2019 | Pal | |
| 2008/0143462 | A1 | 6/2008 | Belisle et al. | |
| 2011/0186549 | A1* | 8/2011 | Ren | H01H 33/664 218/127 |
| 2015/0171084 | A1* | 6/2015 | Lin | H01L 21/32135 257/369 |
| 2016/0079022 | A1* | 3/2016 | An | H01H 50/32 335/187 |
| 2017/0032913 | A1 | 2/2017 | Lee et al. | |
| 2019/0122831 | A1* | 4/2019 | Bedggood | H01H 50/546 |
| 2021/0027963 | A1* | 1/2021 | Zhang | H01H 9/443 |

FOREIGN PATENT DOCUMENTS

| | | | | | |
|---|---|---|---|---|---|
| GB | 2538713 | A | * | 11/2016 | H01H 1/365 |
| JP | 2004139099 | A | | 7/2004 | |
| WO | 2019201735 | A1 | | 10/2019 | |

OTHER PUBLICATIONS

Search Report issued for European Application No. 21150287.7; Application Filing Date Jan. 5, 2021; dated Nov. 9, 2021 (15 pages).

* cited by examiner

RELAY CONTACTOR WITH COMBINED LINEAR AND ROTATION MOTION

BACKGROUND

The following description relates to relay contactors and, more particularly, to a relay contactor with combined linear and rotational motion.

The present standard actuator for high amperage relays, or relay contactors, is to have a linearly moveable electrical conductor with contacts that closes and opens the electrical connections. In these cases, an armature shaft of a solenoid motor (i.e., an actuator) is connected to moveable contacts and moves in a straight linear line (straight-in or straight-out) to open or close the electrical contacts in the relay contactor. This configuration results in the electrically conductive contact surfaces of the contacts making (i.e. close) the electrical contact on a closing movement and then breaking (i.e. open) the electrical contact in an opening movement. As such, the electrical contact area that is required for low voltage drop (i.e., high current carrying density) is also the area that sustains arcing during the closings and openings. Therefore, as the electrical contact area degrades (due to arcing wear along other factors) at the material surface, there is an increase in the voltage drop and a corresponding increase in heating effects.

The material properties of the electrical contact surfaces needed for low voltage drop current carrying capability are typically not the same material properties that are needed to be robust against degradation due to electrical arcing.

BRIEF DESCRIPTION

According to an aspect of the disclosure, a relay contactor is provided and includes a shaft assembly comprising a plate, which is movable between an open position at which the plate is displaced from leads and a closed position at which the plate contacts the leads and an actuation system configured to selectively move the plate into the closed position. At least one of the shaft assembly and the actuation system is configured such that, as the plate moves into and away from the closed position, a movement of the plate relative to the leads comprises at least a non-linear, rotational or an abnormally linear component.

In accordance with additional or alternative embodiments, the movement of the plate relative to the leads includes a normally linear component and the non-linear or abnormally linear component.

In accordance with additional or alternative embodiments, the normally linear component and the non-linear or abnormally linear component are simultaneous, overlapping or sequential.

In accordance with additional or alternative embodiments, the non-linear component includes a rotational component.

In accordance with additional or alternative embodiments, the shaft assembly is configured to facilitate the movement of the plate and includes at least one of a sloped track, a power screw and an alignment bushing.

In accordance with additional or alternative embodiments, the plate and the leads each include one or more contact pads.

In accordance with additional or alternative embodiments, at least one of the contact pads includes electrically conductive materials in a central region thereof and arc-resistant or arc-affecting materials in a perimeter thereof In accordance with additional or alternative embodiments, at least one of the plate and the leads further includes insulation surrounding a contact pad to facilitate arc-breaking relative to the contact pad.

According to as aspect of the disclosure, a relay contactor is provided and includes leads including first contact pads, a shaft assembly including a plate and second contact pads disposed on the plate, the plate being movable between an open position at which the second contact pads are displaced from the first contact pads and a closed position at which the second contact pads contact the first contact pads and an actuation system configured to selectively move the plate into the closed position. At least one of the shaft assembly and the actuation system is configured such that, as the plate moves into and away from the closed position, a movement of the plate relative to the leads brings the second contact pads into contact with the first contact pads along a tangential or partially tangential trajectory.

In accordance with additional or alternative embodiments, as the plate moves into and away from the closed position, the plate rotates or slides relative to the leads.

In accordance with additional or alternative embodiments, as the plate moves into and away from the closed position, the plate moves along a linear trajectory and the tangential or partially tangential trajectory simultaneously, in an overlapping manner or in sequence.

In accordance with additional or alternative embodiments, the shaft assembly is configured to facilitate the movement of the plate and includes at least one of a sloped track, a power screw and an alignment bushing.

In accordance with additional or alternative embodiments, at least one of the first and second contact pads includes electrically conductive materials in a central region thereof and arc-resistant or arc-affecting materials in a perimeter thereof.

In accordance with additional or alternative embodiments, at least one of the plate and the leads further includes insulation surrounding a contact pad to facilitate arc-breaking relative to the contact pad.

According to an aspect of the disclosure, a contact pad is provided and includes a base of electrically conductive material and a contact section affixed to the base. The contact section includes a central portion of electrically conductive material, which is electrically communicative with the base and a perimeter portion of arc-resistant material surrounding the central portion.

In accordance with additional or alternative embodiments, the contact pad further includes a plate or lead of a relay contactor to which the base is affixed.

In accordance with additional or alternative embodiments, the base and the contact section are annular in shape.

In accordance with additional or alternative embodiments, the central and perimeter portions are sloped.

In accordance with additional or alternative embodiments, at least the central portion has a dome or hemispherical shape.

In accordance with additional or alternative embodiments, the base includes a copper alloy, the central portion includes a silver alloy and the perimeter portion includes at least one of a tungsten alloy, a nickel alloy and stainless steel.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a relay contactor is provided and is moveable with combined linear and rotational or abnormally linear (hereinafter referred to as simply "rotational" for purposes of clarity and brevity) movements for closing or opening an electrical circuit. In some cases, the relay contactor is configured such that the linear and rotational movements are simultaneous and, in other cases, the linear and rotational movements are sequential. In each case, the combined or sequential linear and rotational movements result in electrically conductive contact points being made during closing or broken during opening with a wiping or sliding surface motion so that a main electrical arc wear-out operation can be done without direct degradation of main conductive area low voltage drop materials required for low heat dissipation (low electrical resistance).

Figure 1:
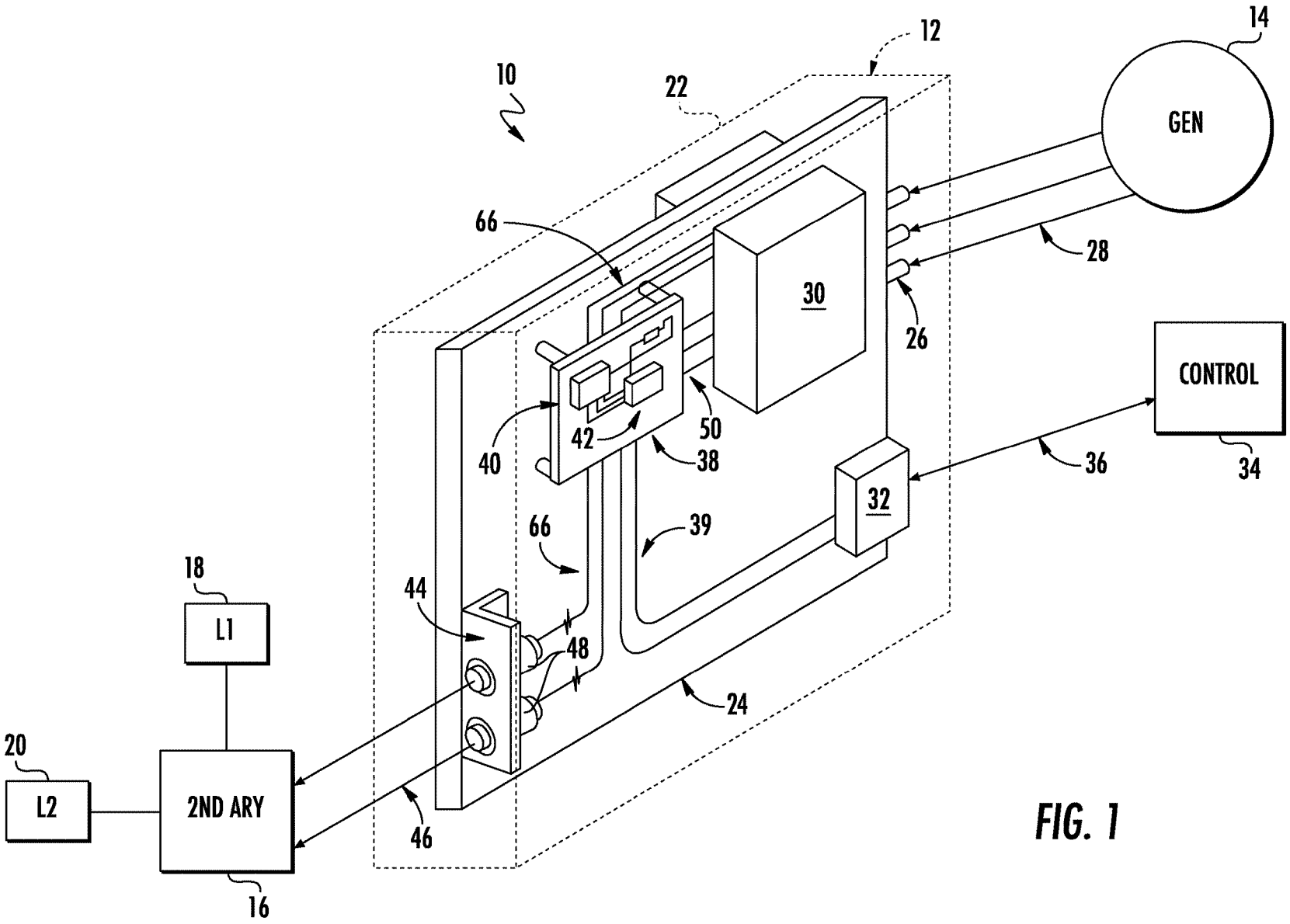
FIG. 1 is a schematic view of an aircraft power distribution system.
Figure 2:
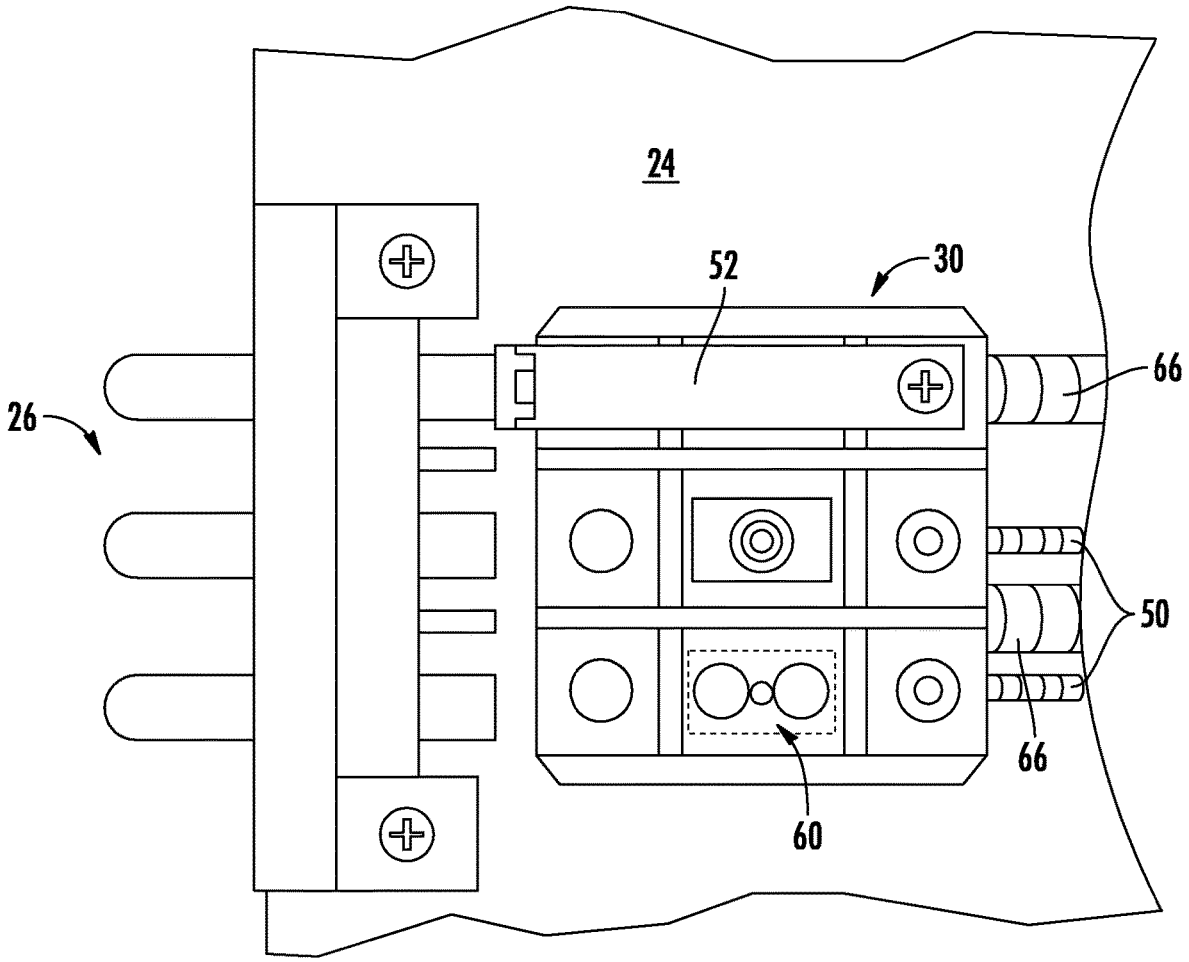
FIG. 2 is a top elevation view of a portion of a primary power distribution board shown in FIG. 1.

With reference to FIGS. 1 and 2, an aircraft power distribution system 10 includes a primary power distribution box 12 that receives power from a generator 14 through power leads 28. The primary power distribution box 12 provides power through supply leads 46 to a secondary power distribution box 16, which distributes power to first and second loads 18 and 20, for example.

The primary power distribution box 12 includes a board 24 that is arranged within a housing 22. The board 24 supports plug-in pins 26 that are connected to the power leads 28. Mechanical contactors 30 act as switches to selectively electrically connect the power leads 28 to the supply leads 46. Circuit breakers 48 are supported by the board 24 to selectively disconnect the supply leads 46 from power in response to an overload. The board 24 also supports a connector 32 that communicates with a control 34 through a harness 36. The control 34 provides commands to the board 24 and/or a secondary circuit board 38 and receives feedback regarding various functions related to the aircraft power distribution system 10. The secondary circuit board 38 in this example is mounted on the board 24 and is connected to the connector 32 and contactors 30 through connections 39. The secondary circuit board 38 includes protection circuitry 40 and secondary power distribution circuitry 42. The protection circuitry 40 monitors the current provided by the generator 14, for example, to prevent the secondary power distribution box 16 from exposure to undesired currents. The secondary power distribution circuitry 42 commands the contactors 30 between open and closed positions.

The contactors 30 are illustrated with control traces 50 and power traces 66, some or all of which are supported by or integral with the board 24 in this example (it is to be understood that the contactors 30, control traces 50 and power traces 66 need not be supported by or integral with the board 24 in all cases), and connected to the secondary circuit board 38 and secondary power distribution connectors 44, respectively. The board 24 is relatively thick to accommodate the current flowing through the power traces 66. The contactors 30 are connected to the plug-in pins 26 by first bands 52 and second bands (not shown). The power traces 66 are selectively provided with power when a moveable conductor plate 60 is moved into a closed position connecting first and second contacts. The moveable conductor plate 60 is moved between open and closed positions by a linear motor and shaft assembly to be described below. The linear motor and shaft assembly is mounted to the board 24 and is commanded by the secondary power distribution circuitry 42 through the control traces 50. The current flowing through the power traces 66 is monitored by the protection circuitry 42 through the control traces 50.

Figure 3:
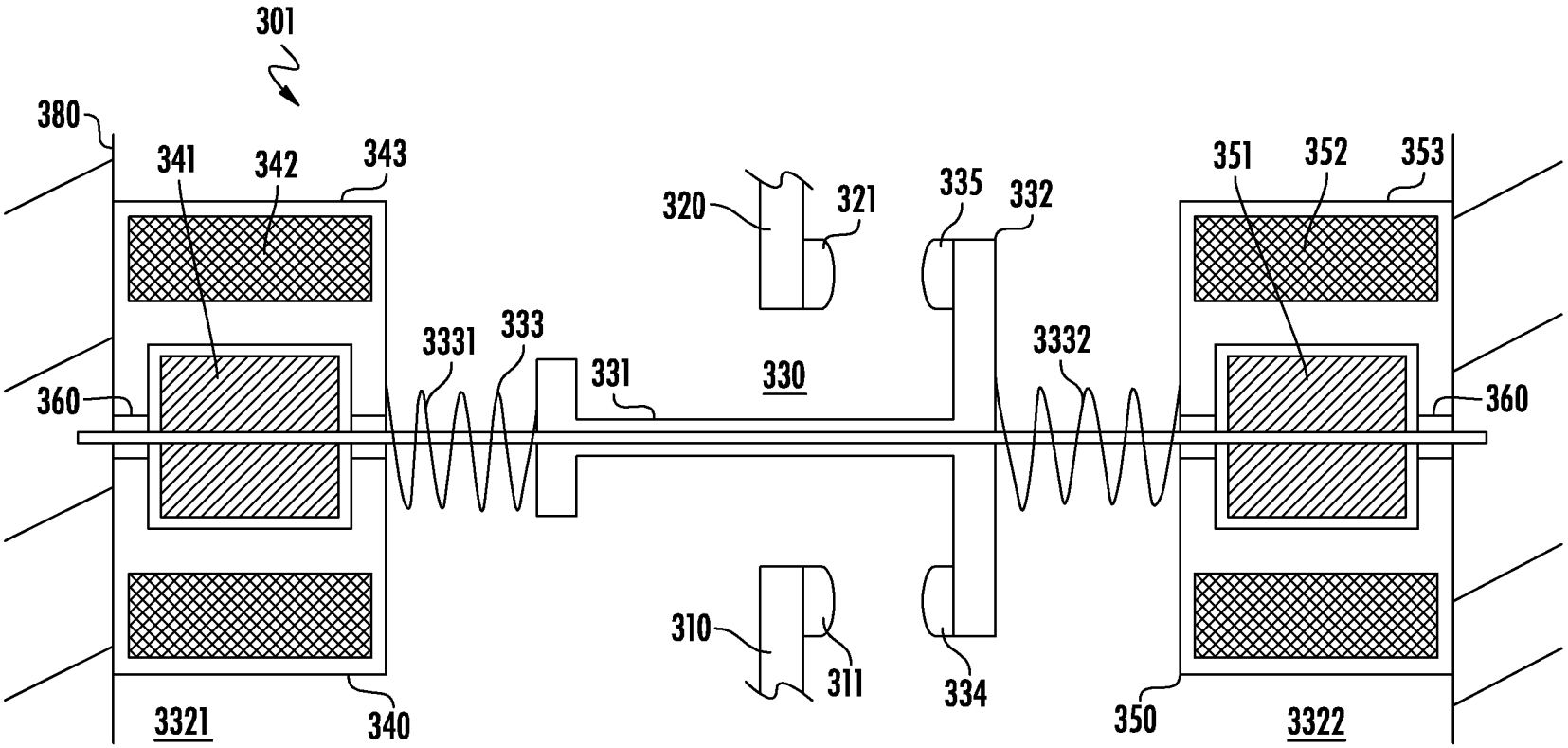
FIG. 3 is a side schematic illustration of a relay contactor for use with the aircraft distribution system of FIG. 1 and the primary power distribution board of FIG. 2 in accordance with embodiments.

With reference to FIG. 3, a relay contactor 301 is provided for use in or as the contactors 30 of FIGS. 1 and 2. As shown in FIG. 3, the relay contactor 301 includes an input lead 310 that is configured to carry current supplied from the power leads 28 of FIG. 2, an output lead 320 that is configured to carry current to the power traces 66 of FIG. 2, a shaft assembly 330, first and second actuators 340 and 350 and first and second bearing assemblies 360 and 370. The relay contactor 301 may further include a housing 380, which is configured to house respectively portions of the input lead 310 and the output lead 320, the shaft assembly 330, the first and second actuators 330 and 340 and the first and second bearing assemblies 350 and 360. As an optional and equally valid configuration, there can be just a single actuator where none of the items 350 and 3322 (second actuator) are required.

The input lead 310 includes an electrically conductive body that extends to an exterior of the housing 380 and a first electrical contact 311 at a proximal end of the electrically conductive body within the housing 380. The output lead 320 includes an electrically conductive body that extends to an exterior of the housing 380 and a second electrical contact 321 at a proximal end of the electrically conductive body within the housing 380.

The shaft assembly 330 includes a shaft 331 that can span the housing 380, a plate 332 that is disposed on the shaft 331 and an elastic element 333. The plate 332 includes an electrically conductive body and third and fourth electrical contacts 334 and 335 at opposite ends of the electrically conductive body. The shaft 331 and the plate 332 are movable together along a longitudinal axis of the shaft 331 between an open position and a closed position. At the open position, the third and fourth electrical contacts 334 and 335 of the plate 332 are displaced from electrical contact with the first electrical contact 311 of the input lead 310 and from electrical contact with second electrical contact 321 of the output lead 320, respectively, such that the input lead 310 and the output lead 320 are not electrically communicative with one another (i.e., current from the power leads 28 is not transmitted to the power traces 66). At the closed position, the third and fourth electrical contacts 334 and 335 of the plate 332 are disposed in electrical contact with the first electrical contact 311 of the input lead 310 and in electrical contact with second electrical contact 321 of the output lead 320, respectively, such that the input lead 310 and the output lead 320 are electrically communicative (i.e., current from the power leads 28 is transmitted to the power traces 66). The elastic element 333, which can include or be provided as one or more springs, can be disposed to apply a bias to the shaft 331 and the plate 332 which urges the shaft 331 and the plate 332 toward assumption of the open position.

In accordance with embodiments, the first and second electrical contacts 311 and 321 and the third and fourth electrical contacts 334 and 335 can be hemispherical or otherwise curved, flat-faced or otherwise configured to form reliable electrical contacts.

The first actuator 340 is coupled to the shaft 331 at a first side 3321 of the plate 332. The second actuator 350 is coupled to the shaft 331 at a second side 3322 of the plate 332. The first and second actuators 340 and 350 are configured to be independently or dependently operable so as to selectively move the shaft 331 and the plate 332 into the closed position in opposition to bias applied by the elastic element 333.

In accordance with embodiments, the first actuator 340 may include or be provided as a linear actuator. In this or other cases, the first actuator 340 may include a first armature 341 through which the shaft 331 extends, first coils 342 surrounding the first armature 341 and a first actuator housing 343 that is supportive of the first bearing assembly 360 and configured to house the first armature 341 and the first coils 342. In accordance with similar embodiments, the second actuator 350 may include or be provided as a linear actuator. In this or other cases, the second actuator 350 may include a second armature 351 through which the shaft 331 extends, second coils 352 surrounding the second armature 351 and a second actuator housing 353 that is supportive of the second bearing assembly 370 and configured to house the second armature 351 and the second coils 352.

With the first and second actuators 340 and 350 configured as described above, the first bearing assembly 360 is disposed to movably support the shaft 331 at the first side 3321 of the plate 332 and the second bearing assembly 370 is disposed to movably support the 331 shaft at the second side 3322 of the plate 332. The first bearing assembly 360 can include bearing elements that are secured in the first actuator housing 343 to permit movements of the shaft 331 along the longitudinal axis of the shaft 331 and the second bearing assembly can include bearing elements that are secured in the second actuator housing 353 to permit the movement of the shaft along the longitudinal axis of the shaft 331.

As shown in FIG. 3, the proximal ends of the electrically conductive bodies of the input and output leads 310 and 320 define or form a space or opening through which the shaft 331 extends, the first actuator 340 and the first bearing assembly 360 are disposed on a first side of the input and output leads 310 and 320 and the plate 332, the second actuator 350 and the second bearing assembly 370 are disposed on a second side of the input and output leads 310 and 320. In addition, as shown in FIG. 3, the elastic element 333 can include a first elastic element 3331, which is anchored at opposite ends thereof to the first actuator 340 and the shaft 331, and a second elastic element 3332, which is anchored at opposite ends thereof to the second actuator 350 and the shaft 331 or the plate 332.

During an operation of the relay contactor 301, the first and second coils 342 and 352 of the first and second actuators 340 and 350 can be independently or dependently energized to thus generate magnetic flux which brings the shaft 331 and the plate 332 into the closed position in opposition to the bias applied by the elastic element 333. To this end, the first and second coils 342 and 352 can be disposed in parallel or in series within an energization circuit and the elastic element 333 can be optimized for use with the various components of the first and second actuators 340 and 350.

Although FIG. 3 has been illustrated with first and second actuators 340 and 350, it is to be understood that at least the second actuator 350 is not required. For example, certain embodiments exist in which the second actuator 350 is not included in the relay contactor 301. In these or other cases, the second bearing assembly 370 could include bearing elements that are secured to the housing 380 at the second side 3322 of the plate 332 and the second elastic element 3332 could be anchored at the opposite ends thereof to the housing 380 and the shaft 331 or the plate 332. In addition, the relay contactor 301 can be configured as a single-phase relay contactor or as a multiple-phase relay contactor with minimal changes to the configuration described herein.

With reference to FIG. 4-7, a relay contactor 401 can be provided with a similar structure as the relay contactor 301 of FIG. 3 with certain modifications as described below. The relay contactor 401 includes leads 410, a shaft assembly 420 and an actuation system 430. The leads 410 can include an input lead 411 and an output lead 412 and one or more first contact pads 413 that are disposed on the input lead 411 and the output lead 412. The shaft assembly 420 includes a shaft 421, a plate 422 that is movable with the shaft 421 and one or more second contact pads 423 that are disposed on the plate 422. The plate 422 is movable with the shaft 421 between an open position and a closed position. At the open position, the plate 422 and the second contact pads 423 are displaced from leads 410 and the first contact pads 413 and thus current is not carried by the plate 422 and the second contact pads 423 from the input lead 411 to the output lead 412. At the closed position, the plate 422 and the second contact pads 423 contact the leads 410 and the first contact pads 413 and thus carry current from the input lead 411 to the output lead 412. The actuation system 430 is configured to selectively move the plate 422 and the second contacts pads 423 into the closed position.

In accordance with embodiments, at least one of the shaft assembly 420 and the actuation system 430 is configured such that, as the plate 422 and the second contact pads 423 move into and away from the closed position, a movement of the plate 422 relative to the leads 410 includes at least a non-linear component, such as a rotation, or an abnormally linear component, such as a linear movement that is not angled normally with respect to the leads 410. For example, the shaft assembly 420 can facilitate the movement of the plate 422 and can include at least one of a sloped track, a power screw and an alignment bushing 424 for a rotational movement. In some cases, the movement of the plate 422 relative to the leads 410 brings the second contact pads 423 into contact with the first contact pads 413 along a tangential or partially tangential trajectory.

Figure 4:
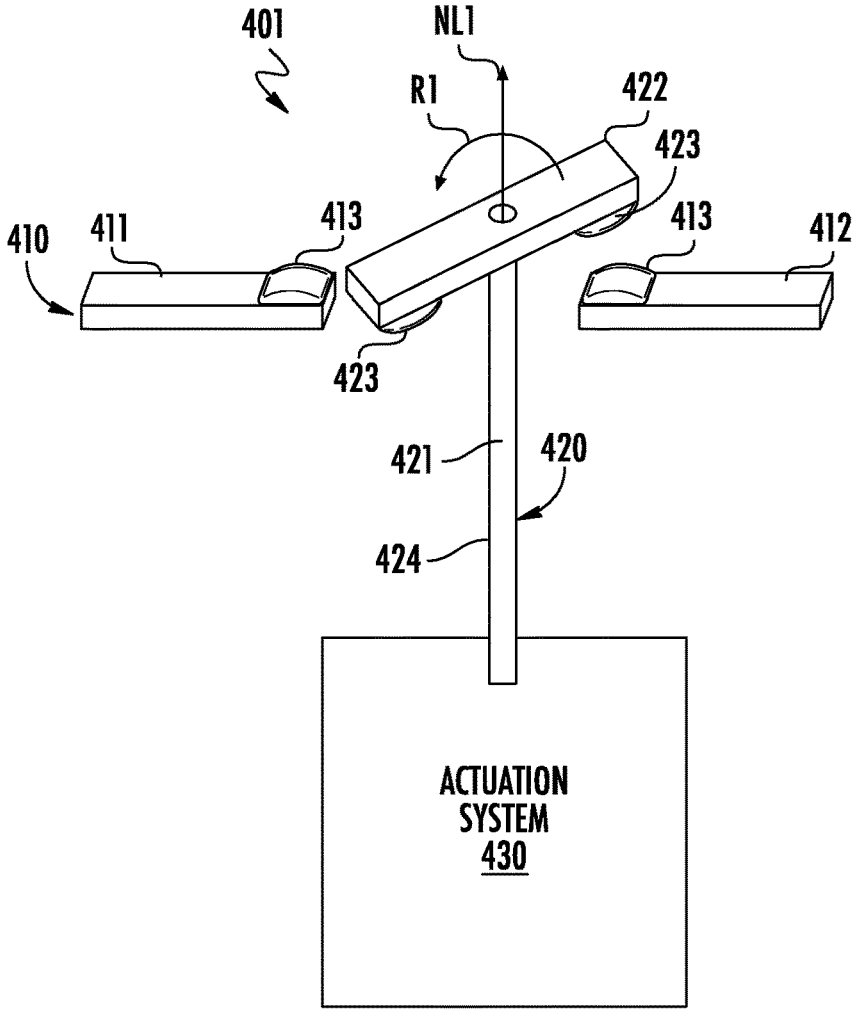
FIG. 4 is a schematic illustration of a relay contactor with simultaneous linear and rotational movements in accordance with embodiments.

As shown in FIG. 4, the movement of the plate 422 relative to the leads 410 includes a normally linear component NL1 and a rotational component R1 that are executed simultaneously, partially simultaneously (i.e., overlapping in any order) or sequentially in any order so that the plate 422 effectively executes a helical movement pattern as it approaches and recedes from the leads 410.

Figure 5:
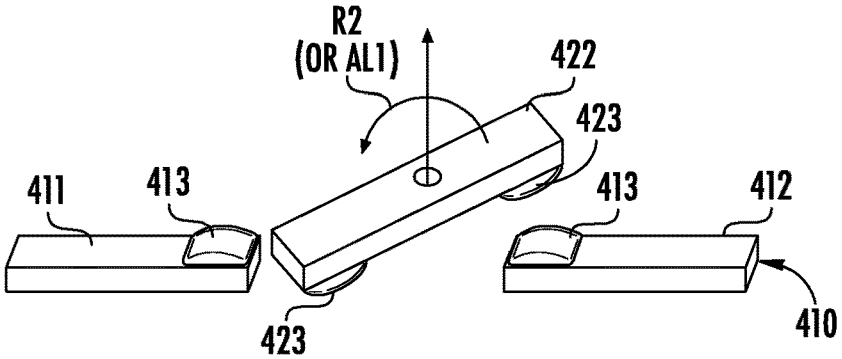
FIG. 5 is a schematic illustration of a relay contactor with a rotational movement in accordance with embodiments.

As shown in FIG. 5, the movement of the plate 422 relative to the leads 410 includes a rotational component R2 that is executed so that the plate 422 effectively executes a circular movement pattern toward and away from the leads 410 as it approaches and recedes from the leads 410. Although, not shown in FIG. 5, the movement of the plate 422 relative to the leads 410 can also include an abnormally linear component AL1 that is executed so that the plate 422 effectively executes a sliding movement pattern toward and away from the leads 410 as it approaches and recedes from the leads 410.

Figure 6:
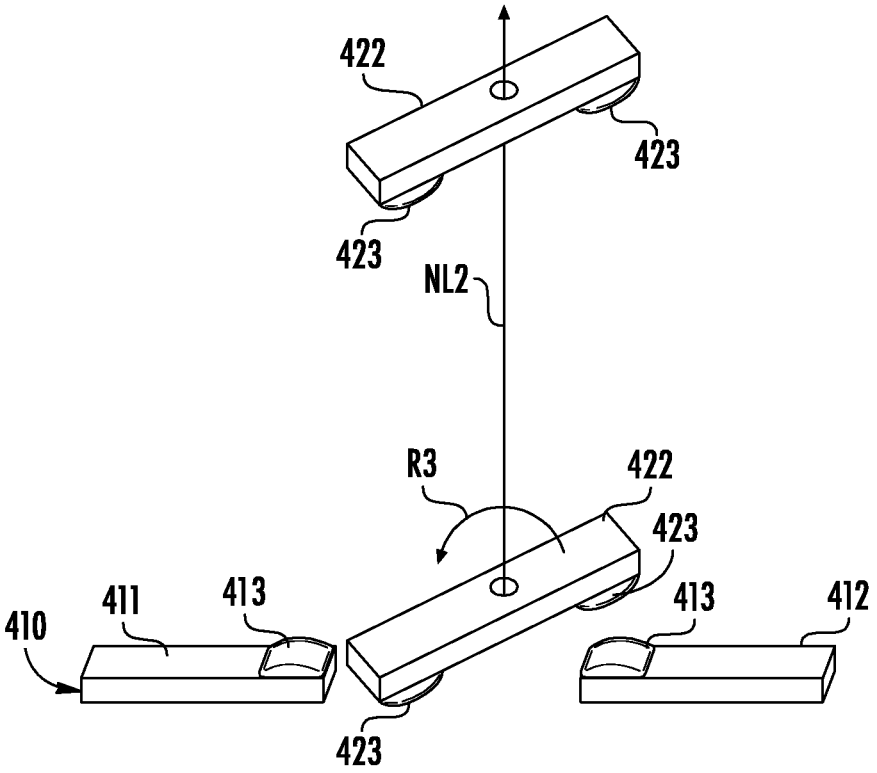
FIG. 6 is a schematic illustration of a relay contactor with sequential rotational and linear movements in accordance with embodiments.

As shown in FIG. 6, the movement of the plate 422 relative to the leads 410 includes a rotational component R3 and an optional normally linear component NL2 that are executed simultaneously, partially simultaneously (i.e., overlapping in any order) or sequentially in any order so that the plate 422 effectively executes a linear movement pattern followed by a circular movement pattern as it approaches the leads 410 or a circular movement pattern followed by a linear movement pattern as it recedes from the leads 410.

Figure 7:
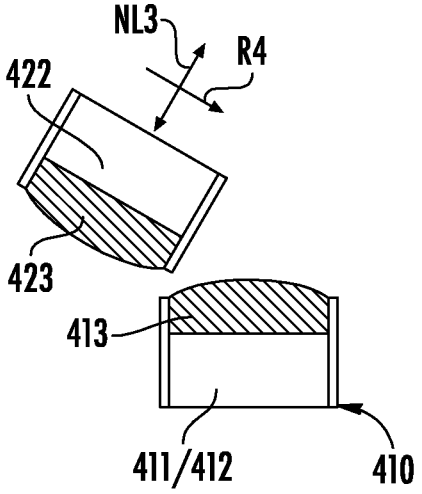
FIG. 7 is a schematic illustration of a relay contactor with abnormal and normal linear movements in accordance with embodiments.

As shown in FIG. 7, the movement of the plate 422 relative to the leads 410 includes a rotational component R4 and an optional normally linear component NL3 that are executed simultaneously, partially simultaneously (i.e., overlapping in any order) or sequentially in any order so that the plate 422 effectively swings toward and away from the leads 410 as it approaches and recedes from the leads 410.

The combinational motion of at least FIGS. 4, 6 and 7 can be easily implemented using a linear cam with a slot on either the stationary (actuator side piece) or moveable (attached to the shaft) piece and a pin on the opposite piece so that, as the linear solenoid actuator at one end or both ends pulls the shaft into the closed position, the pin in the slot forces the desired complex rotational-to-linear movement pattern desired. This allows a completely flexible and non-linear relationship between the axial motion and the rotation motion.

It is to be understood that the embodiments of FIGS. 4-7 are merely exemplary and that other movement patterns, sequences and combinations are possible. It is to be further understood that at least the optional normally linear components NL2 and NL3 of FIGS. 6 and 7 can be discarded.

In each case described herein and others, where the leads 410 include the first contact pads 413 and the plate 422 includes the second contact pads 423, the final movement of the plate 422 relative to the leads 410 during a closing operation and the first movement of the plate 422 relative to the leads 410 during an opening operation brings the second contact pads 423 into contact with the first contact pads 413 along the tangential or partially tangential trajectory where the tangential or partially trajectory is defined with respect to the curvatures of the first contact pads 413 and the second contact pads 423. This tangential or partially trajectory results in arcing which is mostly incident on side surfaces (edges) 4131 and 4231 (see FIG. 8) of the first contact pads 413 and the second pads 423 as opposed to the centralized contact surfaces 4132 and 4232 (see FIG. 8) thereof That is, during a closing operation, as the second contact pads 423 come into electrical contact with the first contact pads 413, an arc that is generated will initially be incident on the side surfaces 4131 and 4231. This condition will persist during the closing operation whereby the arcing might only be incident for a short time on the centralized contact surfaces 4132 and 4232 at the last moment of the closing operation prior to final contact (i.e., during closing operation, time of arcing on side surfaces 4131 and 4231 is much greater than the time of arcing on centralized contact surfaces 4132 and 4232). By contrast, during an opening operation, as the second contact pads 423 recede from electrical contact with the first contact pads 413, an arc that is generated will only be incident for a short time on the centralized contact surfaces 4132 and 4232 at the initial instant of recession whereupon the arc will subsequently become incident on the side surfaces 4131 and 4231. This condition will then persist during the rest of the opening operation (i.e., during opening operation, time of arcing on centralized contact surfaces 4132 and 4232 is much less than the time of arcing on side surfaces 4131 and 4231).

As a result, for the relay contactor 401 of FIGS. 4-7, the centralized contact surfaces 4132 and 4232 are the electrical contact areas that are required for low voltage drop and for high current carrying density but are not the areas that sustain most of the arcing when the relay contactor 401 opens or closes whereas the side surfaces 4131 and 4231 are not the primary electrical contact areas that are required for low voltage drop and for high current carrying density and are the areas that sustain arcing when the relay contactor 401 opens or closes. Thus, even as the side surfaces 4131 and 4231 degrade due to arcing wear at the material surface the centralized contact surfaces 4132 and 4232 do not experience (i.e., significantly reduce) such degradation and there is minimal increase in the voltage drop or a corresponding increase in heating effects.

Figure 8:
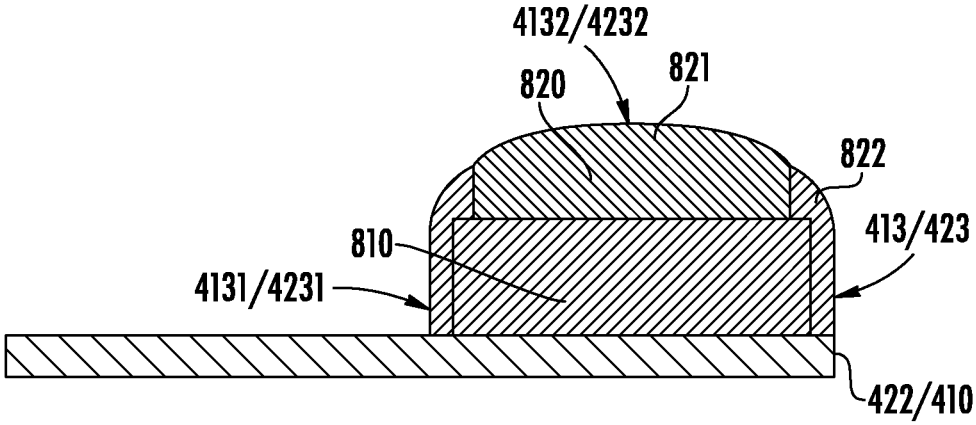
FIG. 8 is a side view of a contact pad in accordance with embodiments.

With reference to FIG. 8, any of the one or more first contact pads 413 or the second contact pads 423 can be configured to encourage the movement of the arcing described above toward the side surfaces 4131 and 4231 and to facilitate the suppression of the arcing itself. To that end, as shown in FIG. 8, first or second contact pads 413 or 423 can include a base 810 of electrically conductive material and a contact section 820 affixed to the base 810 and including a central portion 821 and a perimeter portion 822. The electrically conductive materials of the base 810 and the contact section 820 could be formed as one-piece homogenous or metallurgical-bonded different materials as shown. The base 810 can be affixed to the plate 422 or the leads 410 of the relay contactor 401 of FIGS. 4-7. The central portion 821 can be formed of electrically conductive material and can be electrically communicative with the base 810. The perimeter portion 822 can be formed of arc-resistant conductive material and can surround the central portion 821. At least the perimeter portion can be formed from additive manufacturing processes. Both the base 810 and the contact section 820 can be annular in shape or at least the central and perimeter portions 821 and 822 can be sloped. In some cases, at least the central portion 821 can have a dome shape or a hemispherical shape.

In accordance with embodiments, the first or second contact pads 413 or 423 can include electrically conductive materials in a central region thereof and arc-resistant or arc-affecting materials in a perimeter thereof That is, the base 810 can include a copper alloy, the central portion 821 can include a silver alloy and the perimeter portion 822 can include at least one of a tungsten alloy, a nickel alloy or stainless steel.

Figure 9:
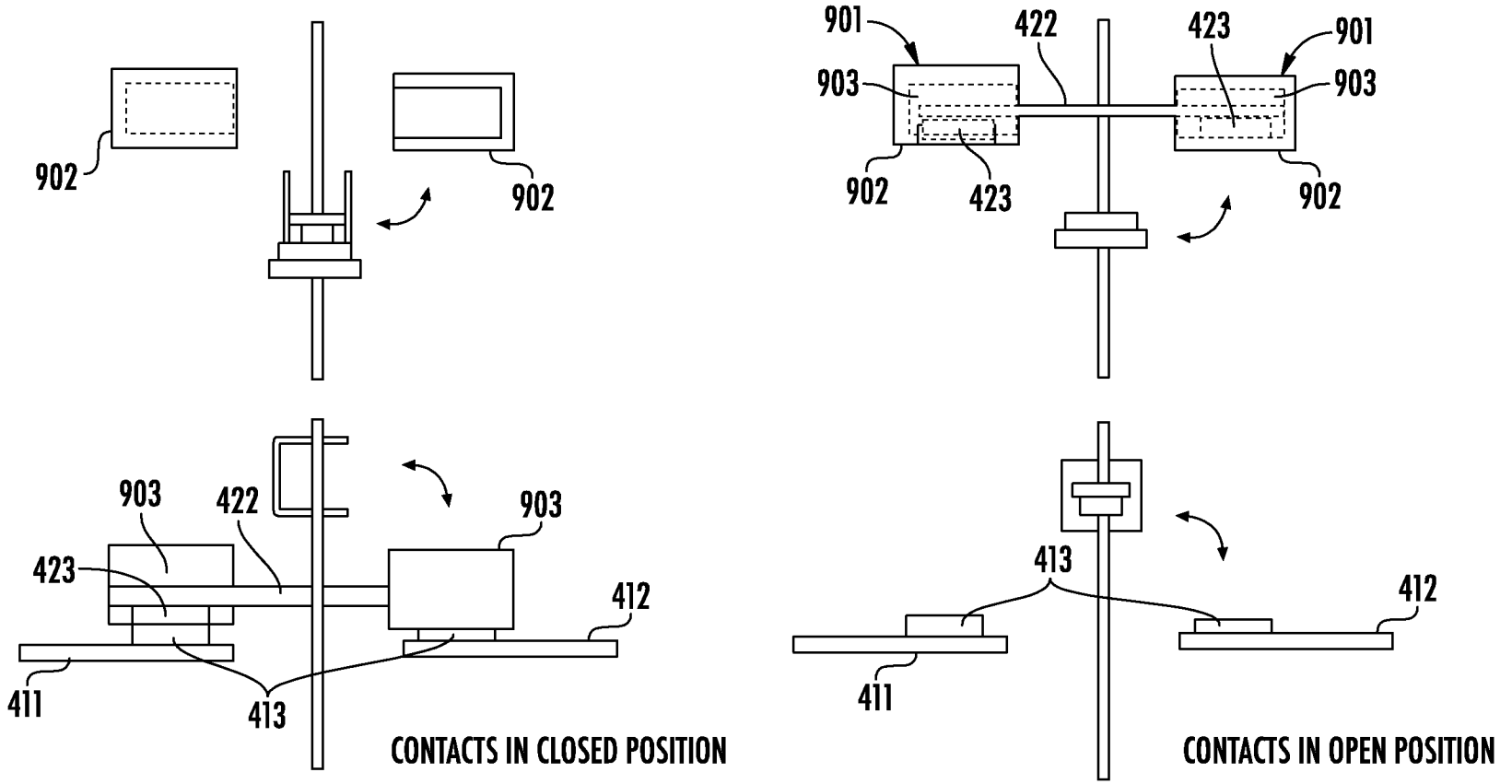
FIG. 9 is a schematic illustration of a relay contactor configuration with an insulating enclosure in accordance with embodiments.

With reference to FIG. 9 and in accordance with further embodiments, an insulating enclosure 901 can be provided for at least some of the first and second contacts 413 and 423 (i.e., the movable second contacts 423). Here, the insulating enclosure 901 has insulation 902 with an opening and the movable second contacts 423 have insulation 903 as well but are able to move into and out of the opening. As the movable second contacts 423 rotate and slide open into the insulating enclosure 901 via the opening so that they occupy the open stationary position, the insulation 903 of the movable second contacts 423 cooperate with the insulation 902 of the insulating enclosure 901. This effectively closes the insulating enclosure 901 (i.e., forms the insulating enclosure as a box) and thus completely blocks any possible arcing that may remain.

Technical effects and benefits of the features described herein are the provision of a relay contactor in which combined linear and rotational movements result in electrically conductive contact areas having a sliding surface motion on the electrical close operation to facilitate the high conductivity of the electrical contact surfaces. On opening (or releasing), the combined linear and rotation movement means the start of the opening gap will cause an arc to start at the edges of main contact areas and move toward edges thereof. Arc extinguishing or suppression can be facilitated by material(s) on the edge (perimeter) of the contact pads. Once again, the simultaneous and combined or the sequential linear and rotational movements protect highly conductive electrical contacts and forces arcing toward areas that are not required to be highly conductive for low voltage drops so that the electrical life is optimized and voltage drop heating is minimized. Thus, highly conductive electrical contact areas where high currents are conducted and edges where the arcing migrates toward can have materials selected and optimized for design life and performance based on where they are physically in the system.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A relay contactor, comprising:

a shaft assembly comprising a shaft and a plate disposed on the shaft, is the plate being movable between an open position at which the plate is displaced from leads and a closed position at which the plate contacts the leads; and an actuation system configured to selectively move the plate into the closed position, at least one of the shaft assembly and the actuation system is configured such that, as the plate moves into and away from the closed position, a movement of the plate relative to the leads comprises:

a linear movement pattern characterized as linear movement of the plate along a longitudinal axis of the shaft simultaneously combined with a rotation or a circular movement pattern characterized as a rotational movement of the plate about the longitudinal axis of the shaft along an entire movement of the plate relative to the leads.

2. The relay contactor according to claim 1, wherein the shaft assembly is configured to facilitate the movement of the plate and comprises at least one of a sloped track, a power screw and an alignment bushing.

3. The relay contactor according to claim 1, wherein the plate and the leads each comprise one or more contact pads.

4. The relay contact according to claim 3, wherein at least one of the contact pads comprises electrically conductive materials in a central region thereof and arc- resistant or arc-affecting materials in a perimeter thereof.

5. The relay contact according to claim 3, wherein at least one of the plate and the leads further comprises insulation surrounding a contact pad to facilitate arc-breaking relative to the contact pad.

6. A relay contactor, comprising:

leads comprising first contact pads;

a shaft assembly comprising a shaft, a plate disposed on the shaft and second contact pads disposed on the plate, the plate being movable between an open position at which the second contact pads are displaced from the first contact pads and a closed position at which the second contact pads contact the first contact pads; and an actuation system configured to selectively move the plate into the closed position, wherein:

at least one of the shaft assembly and the actuation system is configured such that, as the plate moves into and away from the closed position, a movement of the plate relative to the leads comprises a linear movement pattern characterized as linear movement of the plate along a longitudinal axis of the shaft simultaneously combined with a rotation or a circular movement pattern characterized as a rotational movement of the plate about the longitudinal axis of the shaft along an entire movement of the plate relative to the leads, and wherein the movement of the plate relative to the leads brings the second contact pads into contact with the first contact pads along a tangential or partially tangential trajectory.

7. The relay contactor according to claim 6, wherein, as the plate moves into and away from the closed position, the plate rotates or slides relative to the leads.

8. The relay contactor according to claim 6, wherein, as the plate moves into and away from the closed position, the plate moves along a linear trajectory and the tangential or partially tangential trajectory simultaneously, in an overlapping manner or in sequence.

9. The relay contactor according to claim 6, wherein the shaft assembly is configured to facilitate the movement of the plate and comprises at least one of a sloped track, a power screw and an alignment bushing.

10. The relay contactor according to claim 6, wherein at least one of the first and second contact pads comprises electrically conductive materials in a central region thereof and arc-resistant or arc-affecting materials in a perimeter thereof.

11. The relay contact according to claim 6, wherein at least one of the plate and the leads further comprises insulation surrounding a contact pad to facilitate arc-breaking relative to the contact pad.

12. A contact pad, comprising:

a base of electrically conductive material; and a contact section affixed to the base, the contact section comprising:

a central portion of electrically conductive material, which is electrically communicative with the base; and a perimeter portion of arc-resistant material surrounding the central portion, wherein the central portion and the perimeter portion each has a dome or hemispherical shape above and within a footprint of the base and the dome or hemispherical shape of the central portion differs from the dome or hemispherical shape of the perimeter portion.

13. The contact pad according to claim 12, further comprising a plate or lead of a relay contactor to which the base is affixed.

14. The contact pad according to claim 12, wherein the base and the contact section are annular in shape.

15. The contact pad according to claim 12, wherein the central and perimeter portions are sloped.

16. The contact pad according to claim 12, wherein the base comprises a copper alloy, the central portion comprises a silver alloy and the perimeter portion comprises at least one of a tungsten alloy, a nickel alloy and stainless steel.

* * * * *